US005785721A

United States Patent [19]

Brooker

[11] Patent Number: 5,785,721

[45] Date of Patent: Jul. 28, 1998

[54] FUEL INJECTOR NOZZLE WITH PREHEAT SHEATH FOR REDUCING THERMAL SHOCK DAMAGE

[75] Inventor: Donald Duane Brooker, Hopewell Junction, N.Y.

[73] Assignee: Texaco Inc., White Plains, N.Y.

[21] Appl. No.: 791,189

[22] Filed: Jan. 31, 1997

[51] Int. Cl.[6] ..... C10J 3/46; C10J 3/48

[52] U.S. Cl. ..... 48/86 R; 48/197 R; 48/206; 48/DIG. 7; 239/419.5; 239/422

[58] Field of Search ..... 48/86 R, 197 R, 48/95, 215, 69, 77, DIG. 2, DIG. 7, 206; 239/422, 419.5

[56] References Cited

U.S. PATENT DOCUMENTS 4,443,228 4/1984 Schlinger ..... 48/86 R
4,443,230 4/1984 Stellaccio ..... 48/197 R
4,952,218 8/1990 Lipp et al. ..... 48/86 R

*Primary Examiner*—Hien Tran
*Attorney, Agent, or Firm*—Henry H. Gibson; Rodman & Rodman

[57] ABSTRACT

The operating life of a fuel injector nozzle for a gasifier is prolonged by shielding the fuel injector nozzle with a preformed protective insulating sheath before the fuel injector nozzle is installed inside a preheated reaction chamber of the gasifier. The thermal insulating sheath has low thermal conductivity and is placed around the fuel injector nozzle body. The thermal sheath can also be positioned to cover a downstream end of the fuel injector nozzle that includes a nozzle portion. The thermal insulating sheath is supported by ceramic rope, solder or metal wire and is gradually consumable in the environs of the reaction chamber immediately after the fuel injector nozzle is installed. Before the thermal sheath is consumed, it moderates the temperature rise rate of the fuel injector nozzle while the fuel injector nozzle is being installed in the gasifier.

13 Claims, 1 Drawing Sheet

FUEL INJECTOR NOZZLE WITH PREHEAT SHEATH FOR REDUCING THERMAL SHOCK DAMAGE

BACKGROUND OF THE INVENTION

This invention is directed to fuel injector nozzles for gasifiers, and more particularly to an apparatus and method for protecting fuel injector nozzles from thermal shock damage when such fuel injector nozzles are installed in a preheated reaction chamber of the gasifier.

The gasification process is generally carried out by passing an oil, gas or water-based carbonaceous slurry of particulate coal or coke ("carbonaceous feed") and an oxygen-containing gas into the reaction chamber of a gasifier at operating temperatures that can range from about 2400° F. to about 3000° F. The operating temperature of the gasifier causes the oxygen-containing gas to rapidly react with the carbonaceous feed as it enters the reaction chamber.

The carbonaceous feed is usually dispensed in atomized form from the fuel injector nozzle of the gasifier into the reaction chamber along with the oxygen-containing gas. Since the oxygen-containing gas and carbonaceous feed have a self-sustaining exothermic reaction at typical operating temperatures of the gasifier, the fuel injector nozzle is not provided with an igniter. U.S. Pat. No. 4,808,197 to Avers and 4,443,230 to Stellacio generally show the processing of carbonaceous fuels, such as coal, in a gasifier to produce gaseous mixtures including hydrogen and carbon monoxide, referred to as synthesis gas.

Because of the relatively high operating temperatures of the gasifier, it is occasionally necessary to repair or replace one or more components of the gasifier, such as the fuel injector nozzle. The gasifier must thus be shut down and the fuel injector nozzle deactivated to allow cooling of the gasifier to temperatures that permit whatever repair or replacement operations are desirable.

The fuel injector nozzle is usually constructed as a removable component of the gasifier and is withdrawn when needed to facilitate repair of the gasifier structure, as well as servicing or replacement of the fuel injector nozzle.

When repair or servicing of the gasifier is completed and operation of the gasifier is to be resumed, it is typical practice to raise the temperature of the gasifier reaction chamber to a start-up level before recommencing the gasification process. The reaction chamber must thus be preheated to a desired start-up temperature, such as about 1600° F. to about 2400° F.

Since the fuel injector nozzle may not include an igniter, it is necessary to preheat the reaction chamber of the gasifier using an auxiliary preheat burner that operates with an igniter. Known preheat burners often use propane gas as the fuel.

The preheat burner is installed at an inlet end of the gasifier in a manner which permits subsequent removal of the preheat burner after the preheat burner operation has raised the temperature of the reaction chamber to the desired start-up temperature. The duration of the preheat process depends upon the size and mass of the reactor vessel.

Once the reaction chamber is preheated to the desired start-up temperature, the burner is normally removed from the gasifier to allow installation of the fuel injector nozzle.

The fuel injector nozzle, prior to installation on the preheated gasifier, is generally relatively cold compared to the start-up temperature of the gasifier. With a substantial temperature difference between the pre-installed fuel injector nozzle and the start-up temperature of the gasifier, the fuel injector nozzle, upon installation, is subject to temperature increase at a relatively high rate. Different rates of thermally induced physical expansion, because of abrupt temperature changes, can cause expansion-related cracking of fuel injector nozzle components. Thus it is almost inevitable that the fuel injector nozzle experience immediate thermal shock damage when installed on the gasifier. As used herein, the phrase "thermal damage" is intended to include thermal shock damage.

Thermal damage is often manifested in the formation of cracks, for example, around the outlet orifice of the fuel injector nozzle which can include refractory elements. Such refractory elements are likely to develop small fissures that are eventually subject to spalling, which is a jagged outcropping of refractory material. In addition, thermally induced fatigue phenomena can occur in metal structural elements of the fuel injector nozzle exposed to high temperature gasifier environments.

Thermal damage to the fuel injector nozzle during installation is particularly insidious, since the gasification process generates a highly corrosive liquid slag and/or corrosive gases that can penetrate refractory materials of the fuel injector nozzle and hasten degradation of the fuel injector nozzle components. The service life of a fuel injector nozzle is often directly related to the amount of thermal damage incurred during installation of the fuel injector nozzle on the gasifier. Service life of the fuel injector nozzle is nearly always compromised by the initial thermal damage that develops during fuel injector installation.

It is thus desirable to slow the rate of temperature rise of a fuel injector nozzle and minimize thermal damage to the fuel injector nozzle when it is cold-installed into a gasifier that is at start-up temperature. It is also desirable to minimize thermal damage to the fuel injector nozzle when it has been allowed to heat up to start-up temperature and thereafter relatively cool oxygen and carbonaceous streams are introduced through the fuel injector nozzle into the reaction chamber.

OBJECTS OF THE INVENTION

Among the several objects of the invention may be noted the provision of a novel fuel injector nozzle for a gasifier, a novel fuel injector nozzle for a gasifier which incorporates thermal shielding to slow the rate of temperature rise, a novel fuel injector nozzle for a gasifier which incorporates gradually destructible thermal shielding to permit eventual exposure of the main structural elements of the fuel injector nozzle to the gasifier environment at gradually increasing temperature rise rates, a novel thermal-shielded fuel injector nozzle for a gasifier that permits operation of the fuel injector nozzle while the thermal shield on the fuel injector nozzle gradually or rapidly dissipates, and a novel method of reducing thermal shock to a fuel injector nozzle of a gasifier.

Other objects and features of the invention will be in part apparent and in part pointed out hereinafter.

SUMMARY OF THE INVENTION

In accordance with the invention, a preformed thermal insulating sheath is provided around exterior portions of the fuel injector nozzle which are disposed within the reaction chamber of the gasifier. The insulating sheath can cover the downstream or outlet nozzle end of the fuel injector nozzle and is preferably held in position using securing devices such as consumable wire, solder or ceramic rope. Adhesive bonding of some or all portions of the thermal insulating sheath to the exterior body of the fuel injector nozzle is also feasible.

The thermal sheath and all supporting devices or adhesive for holding the thermal sheath in position on the gasifier are formed of materials that are partially or totally consumable in the preheated thermo-chemical environment of the gasifier reaction chamber. Once the supporting devices are partially or totally consumed, any non-consumed portions of the thermal sheath can be blown away from the fuel injector nozzle by nitrogen purge stream, the feed stream of carbonaceous feed and oxygen-containing gas. The degradation, deterioration and consumption of the thermal sheath begins at the moment of installation of the fuel injector nozzle in the gasifier and continues for a predetermined time thereafter.

When the thermal sheath is substantially consumed in the reaction chamber, the exterior surface of the fuel injector nozzle is exposed to the thermo-chemical environment of the gasifier. At such time of exposure, the fuel injector nozzle will have been heated at a modified temperature rise rate due to the presence of the thermal insulating sheath, thereby minimizing thermal damage that would otherwise occur without the thermal sheath. Minimization of thermal damage at installation of the fuel injector nozzle to the gasifier serves to prolong the service life of the fuel injector nozzle.

The invention accordingly comprises the constructions and method hereinafter described, the scope of the invention being indicated in the claims.

DESCRIPTION OF THE DRAWING

In the accompanying drawing.

DETAILED DESCRIPTION OF THE INVENTION

Figure 1:
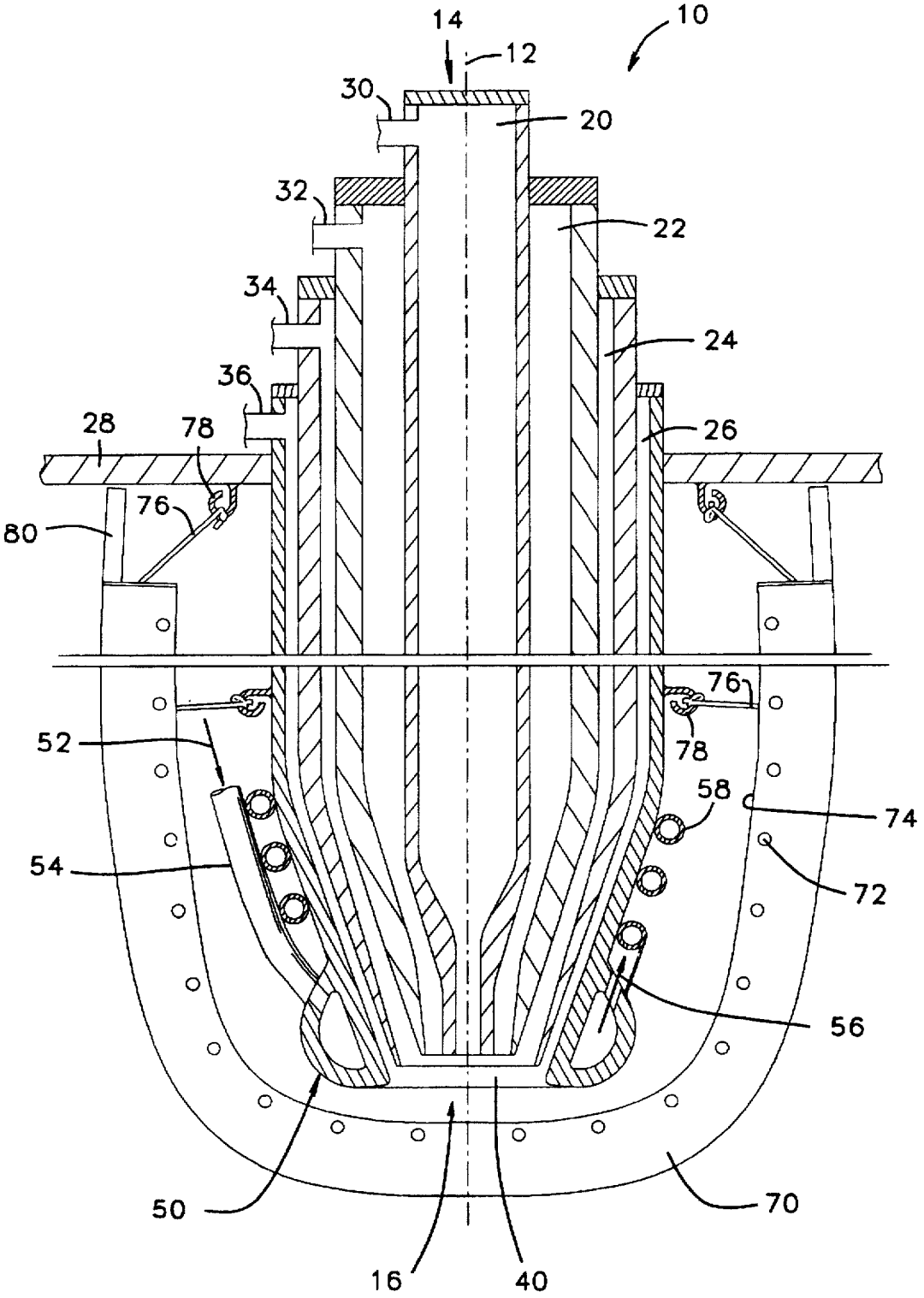
FIG. 1 is a sectional view of a fuel injector nozzle with a thermal insulating sheath incorporating one embodiment of the invention.

Referring to FIG. 1, a fuel injector nozzle of the type described in U.S. Pat. No. 4,443,230 to Stellacio is generally indicated by the reference number 10.

The fuel injector nozzle 10 is a partial oxidation fuel injector nozzle with cylindrical symmetry about a central axis 12. The fuel injector nozzle 10 includes an upstream end 14 and a downstream end 16. The fuel injector nozzle 10 further includes a central conduit 20 and concentric annular conduits 22, 24 and 26 that converge to form a nozzle 40 at the downstream end 16. A mounting flange 28 joined to the conduit 26 engages an open inlet end of the gasifier reaction chamber (not shown) and permits the nozzle 40 to be suspended in the reaction chamber.

The conduits 20, 22, 24 and 26 include respective inlet pipes 30, 32, 34 and 36. The inlet pipe 30 provides a feed stream of gaseous fuel material such as, for example, from the group of free oxygen-containing gas, steam, recycled product gas and hydrocarbon gas. The inlet pipe 32 provides a pumpable liquid phase slurry of solid carbonaceous fuel such as, for example, a coal-water slurry. The inlet pipes 34 and 36 provide two separate streams of fuel, such as, for example, free oxygen-containing gas optionally in admixture with a temperature moderator.

The oxygen-containing gas and carbonaceous slurry streams from the conduits 20, 22, 24 and 26 merge at a predetermined distance beyond the nozzle 40 at a predetermined location in the reaction chamber to form a reaction zone. The merging of the carbonaceous slurry exiting the conduit 22 with the oxygen-containing streams from the conduits 20, 24 and 26 causes the carbonaceous slurry to break up or atomize, which promotes product reaction and enhances the heat-induced gasification process.

An annular coaxial water-cooling jacket 50 is provided at the downstream end 16 of the fuel injector nozzle 10 surrounding the nozzle 40. The cooling jacket 50 receives incoming water 52 through an inlet pipe 54. Water 52 exits from the annular cooling jacket 50 at 56 into a cooling coil 58 and exits from the cooling coil 58 in any suitable known recirculation or drainage device.

When repair or replacement of the fuel injector nozzle 10 is required, it is usually necessary to remove the fuel injector nozzle from the reaction chamber (not shown) of the gasifier. Thus, the fuel injector nozzle 10 is deactivated and allowed to cool down before being lifted off the reaction chamber via the mounting flange 28. Removal of the fuel injector nozzle 10 may also be necessary to permit servicing of other structures within the gasifier.

When servicing of the fuel injector nozzle 10 and/or any other gasifier structure is completed, the gasifier may resume operation. A resumption of operation requires that the reaction chamber be elevated in temperature to a desired start-up temperature of approximately 1600°–2400° F. Since the fuel injector nozzle does not normally include an igniter and is not designed for start-up operation, another heat source must be used to heat the reaction chamber to a temperature level that can sustain operation of the fuel injector nozzle.

A known preheat burner (not shown) is installed in the gasifier to accomplish this purpose, and is removed when the desirable start-up temperature is reached.

The fuel injector nozzle 10, when installed in the preheated gasifier, will thus encounter the start-up temperature of the reaction chamber. The fuel injector nozzle is relatively cool compared to the reaction chamber temperature, and vulnerable to thermal damage when first installed in the reaction chamber.

Installation of the fuel injector nozzle 10 in the gasifier is one of the most critical phases of gasifier operation. Any thermal damage that occurs to the fuel injector nozzle 10 during installation will worsen with the passage of time due to the continuous high-temperature operation of the gasifier and the fuel injector nozzle. Thermal damage to the fuel injector nozzle 10 at installation in the gasifier thus has an adverse effect on the service life of the fuel injector nozzle and the productive operation of the gasifier. Generally, water cooling of the fuel injector nozzle 10 can be initiated prior to installation of the fuel injector nozzle.

In order to minimize thermal shock damage to the fuel injector nozzle 10 at a start-up operation of the gasifier, I have developed a flexible consumable thermal sheath 70 arranged to envelop the periphery of the fuel injector nozzle 10 before such fuel injector nozzle is installed on the gasifier. The thermal sheath 70 can be a preformed insulating blanket or moldable fiber mix 1 to 2 inches thick and of constant thickness that wraps around the orifice of the fuel injector nozzle. The thermal sheath 70 can be formed, for example, of ceramic fibers, gypsum, mineral wool, rock slag, granulated slag, diatomaceous earth, or a combination of these, bonded together with any suitable known binder such as inorganic clay, cements, oils, or glues. Ordinary sheet stock of fiberglass insulation may also be used.

If desired, electric heating elements 72 can be provided in the sheath 70 or adjacent an inside surface 74 of the sheath 70 and held in place with ceramic rope, wires, solder or a low to medium temperature bonding agent (not shown). The heaters 72 can be operated prior to installation of the fuel injector nozzle 10 in the gasifier.

The sheath 70 is supported around the periphery of the fuel injector nozzle 10 by support means 76 such as ceramic rope, solder non-reticulated steel wire or low temperature metal alloy wires, which are destructible at approximately 2000° F. and are secured to an anchoring device such as a hook 78 provided on the underside of the mounting plate 28 or around the conduit 26. Preferably the support structure or support means 76 will have a set melting point or will degrade at a set temperature that is below the operating temperature of the reaction chamber. As a further option, the thermal sheath 70 can be held in place on the fuel injector nozzle 10 by a coil of wire (not shown) that surrounds the exterior of the thermal sheath 70 and hugs the sheath to the fuel injector nozzle periphery.

The thermal sheath 70 can be a continuous preformed structure or a quiltwork arrangement of preformed smaller sheaths. Preferably the sheath 70 covers the nozzle 40 of the fuel injector nozzle 10.

To facilitate installation of the thermal sheath 70 around the fuel injector nozzle 10, a rigid cover 80 formed of wood, plastic or sheet metal, for example, can be provided to envelop the sheath 70 or support the sheath 70 against the nozzle 40. The cover 80 can be secured to the sheath 70 by wires or glue, for example, or secured with the sheath 70 to the mounting plate 28 by wires prior to installation of the fuel injector nozzle 10 in the gasifier.

Alternatively, a reticulated structure such as chicken-wire (not shown) can be arranged around the exposed surface of the thermal sheath and affixed to the mounting flange 28, using the anchor hooks 78. If desired, further securement of the thermal sheath 70 can be made by bonding the inside surface 74 to the outer conduit 26. However, no matter what support means 76 is used for the sheath 70, the temperature tolerance of such support should permit melting, degradation, or any other type of deterioration of the support means 76 at operating temperatures of the reactor so as to permit the sheath 70 and any cover material 80 to fall away from the fuel injector nozzle 10 when the feed stream is introduced into the fuel injector nozzle.

Also no matter what type of thermal sheath 70 is secured around the fuel injector nozzle 10, an essential characteristic of the sheath 70 is that it undergoes structural failure, decomposition, degradation and/or consumption after a predetermined time in the preheated gasifier. Structural failure of the supporting or retaining means 76 can also be influenced by the initiation of process flow through the fuel injector nozzle, as well as slurry flow.

During the time that the retaining means 76 and the thermal sheath 70 remain in place, the fuel injector nozzle 10 is gradually heated in the reaction chamber to the start-up temperature, thereby minimizing thermal damage that would otherwise occur from instant exposure of the fuel injector nozzle structure to the heated environs of the reaction chamber.

The thermal sheath 70 thus serves to moderate heat transfer from the reaction chamber of the gasifier to the relatively cold fuel injector nozzle 10 upon installation of the fuel injector nozzle 10 into the gasifier. Degradation and ultimate consumption of the thermal sheath 70 in the gasifier due to the operating temperatures in the reaction chamber results in the fuel injector nozzle 10 eventually being directly exposed to the reaction chamber environment, but with process flows initiated which eventually reduce thermal cycling.

However, before there is direct exposure of the fuel injector nozzle to the reaction chamber environment the temperature increase rate of the fuel injector nozzle at installation is minimized with the thermal sheath and is less likely to cause the amount of thermal damage that generally occurs without the thermal sheath. Thus, the fuel injector nozzle, with minimized thermal damage upon installation, can withstand the operating temperatures of the gasifier reaction chamber for a prolonged period of service time because a decreased amount of thermal damage will occur when the fuel injector nozzle is installed in accordance with the present invention. A significant factor that affects the service life of the fuel injector nozzle is the amount of thermal damage incurred at installation.

All constituents of the thermal sheath, including the support elements when consumed or dropped away from the fuel injector nozzle into the environment of the reaction chamber do not provide any significant residue or accumulation within the gasifier that interferes with the gasification process.

Some advantages of the present invention evident from the foregoing description are a fuel injector nozzle with a flexible, consumable, protective thermal sheath. The thermal sheath controls the temperature rise rate of the fuel injector nozzle upon installation into a preheated gasifier.

A further advantage of the invention is that the thermal sheath minimizes thermal damage when the fuel injector nozzle is installed in the gasifier and thus alleviates further thermal fatigue damage that can occur during normal operation of the fuel injector nozzle. The fuel injector nozzle with minimized thermal damage at installation thus has an increased service life.

In view of the above, it will be seen that the several objects of the invention are achieved and other advantageous results attained.

As various changes can be made in the above constructions and method without departing from the scope of the invention, it is intended that all matter contained in the above description or shown in the accompanying drawing shall be interpreted as illustrative and not in a limiting sense.

What is claimed is:

1. A fuel injector nozzle for a gasifier comprising, a) a fuel injector nozzle body having an exterior, an upstream end and a downstream end, the downstream end being in the form of a nozzle portion, b) at least a first conduit extending within the nozzle body from the upstream end to the downstream end to permit flow of a stream of oxygen-containing gas from the nozzle portion at the downstream end, c) at least a second conduit extending within the nozzle body from the upstream end to the downstream end to permit flow of a pumpable carbonaceous slurry or gas from the nozzle portion at the downstream end, said second conduit being positioned substantially parallel to said first conduit at the upstream end, and d) a preformed sheath of insulating material provided around the exterior of the fuel injector nozzle body between the upstream end and the downstream end, said preformed insulating material being gradually consumable when disposed in environs of a preheated reaction chamber of a gasifier.

2. A fuel injector nozzle for a gasifier as claimed in claim 1, wherein the fuel injector nozzle includes a mounting plate and retaining means provided on said preformed insulation sheath for securing the preformed insulating sheath to the mounting plate, said retaining means being consumable in the environs of a preheated reaction chamber of a gasifier.

3. A fuel injector nozzle for a gasifier as claimed in claim 2, wherein the retaining means is selected from the group consisting of reticulated chicken-wire, ceramic rope, non-reticulated steel wire, and metal alloys that are destroyed at approximately 2000° F.

4. A fuel injector nozzle for a gasifier as claimed in claim 1, wherein the fuel injector nozzle includes a mounting plate and the preformed insulating sheath is secured to said mounting plate.

5. A fuel injector nozzle for a gasifier as claimed in claim 1, wherein electric heaters are provided in said preformed insulating sheath for preheating said fuel injector nozzle body before it is installed in a gasifier reaction chamber.

6. A fuel injector nozzle for a gasifier as claimed in claim 5, wherein said preformed insulating sheath has an inside surface that confronts the fuel injector nozzle body and the electric heaters are provided on said inside surface to heat said fuel injector nozzle body before it is installed in a gasifier reaction chamber.

7. A fuel injector nozzle for a gasifier as claimed in claim 1, wherein said preformed insulating sheath envelops a predetermined portion of the exterior of the fuel injector nozzle body that is received in a reaction chamber of the gasifier.

8. A fuel injector nozzle for a gasifier as claimed in claim 1 wherein said preformed insulating sheath envelops the nozzle portion.

9. A method of extending the operating life of a fuel injector nozzle of a gasifier comprising, (a) preforming a sheath of a thermal insulating material that gradually becomes consumed in environs of a preheated reaction chamber of a gasifier, (b) placing the preformed thermal insulating sheath over predetermined portions of a fuel injector nozzle to envelop the predetermined portions of the fuel injector nozzle prior to installation of the fuel injector nozzle in the preheated reaction chamber of the gasifier, (c) supporting the preformed thermal sheath on the fuel injector nozzle to retain the preformed thermal sheath over a nozzle end of the fuel injector nozzle, and (d) installing the fuel injector nozzle with the preformed thermal insulating sheath in the preheated reaction chamber of the gasifier such that the preformed thermal insulating sheath is exposed to the environs of the preheated reaction chamber whereby prior to being consumed the preformed thermal insulating sheath limits temperature rise rate of the fuel injector nozzle when the fuel injector nozzle is installed in the preheated reaction chamber of the gasifier.

10. The method of claim 9, wherein the thermal sheath is supported on the fuel injector nozzle with a sheath support that is consumable in the environs of the preheated reaction chamber and positioning the preformed thermal insulating sheath on the fuel injector nozzle to permit falling away of the sheath from the nozzle end of the fuel injector nozzle upon consumption of the sheath support, as process flow is initiated in the fuel injector nozzle.

11. The method of claim 10, including forming the support for the preformed thermal insulating sheath of ceramic rope.

12. The method of claim 10, including forming the support for the preformed thermal insulating sheath of reticulated wire.

13. The method of claim 10 including forming the support for the preformed thermal insulating sheath of low temperature metal allow wires which are destructible at approximately 2000° F.

* * * * *

UNITED STATES PATENT AND TRADEMARK OFFICE

CERTIFICATE OF CORRECTION

PATENT NO : 5,785,721

DATED : July 28, 1998

INVENTOR(S) : Donald Duane BROOKER

It is certified that error appears in the above-identified patent and that said Letters Patent is hereby corrected as shown below:

In Column 1, line 27, change "Avers" to --Ayers--.

In Column 8, line 31, change "allow", to --alloy--.

Signed and Sealed this

Eleventh Day of May, 1999

*Attest:*

Q. TODD DICKINSON

*Attesting Officer*

*Acting Commissioner of Patents and Trademarks*